United States Patent [19]

Sato et al.

[11] Patent Number: 4,939,553

[45] Date of Patent: Jul. 3, 1990

[54] ORIGINAL DETECTION APPARATUS

[75] Inventors: Isamu Sato, Yokohama; Yoshihiro Funamizu, Soka, both of Japan

[73] Assignee: Canon Kabushiki Kaisha, Tokyo, Japan

[21] Appl. No.: 331,172

[22] Filed: Mar. 31, 1989

[30] Foreign Application Priority Data

| | | | |
|---|---|---|---|
| Apr. 4, 1988 | [JP] | Japan | 63-81212 |
| May 11, 1988 | [JP] | Japan | 63-112561 |
| Feb. 22, 1989 | [JP] | Japan | 01-42053 |

[51] Int. Cl.[5] ..... G03G 15/00

[52] U.S. Cl. ..... 355/311; 355/309

[58] Field of Search ..... 355/311, 309, 308

[56] References Cited

U.S. PATENT DOCUMENTS

| | | | |
|---|---|---|---|
| 4,456,372 | 6/1984 | Yamaguchi | 355/311 X |
| 4,764,788 | 8/1988 | Watashi et al. | 355/311 X |
| 4,766,404 | 8/1988 | Ishida et al. | 355/7 |

FOREIGN PATENT DOCUMENTS

| | | | |
|---|---|---|---|
| 193777 | 9/1986 | European Pat. Off. | 355/311 |
| 62-6242 | 1/1987 | Japan | 355/311 |
| 62-6243 | 1/1987 | Japan | 355/311 |
| 62-65028 | 3/1987 | Japan | 355/311 |

*Primary Examiner*—R. L. Moses

*Attorney, Agent, or Firm*—Fitzpatrick, Cella, Harper & Scinto

[57] ABSTRACT

An original detection apparatus includes a placing table for placing an original thereon, an openable/closable pressing member for covering the original placed on the placing table, an original detection unit, arranged below the placing table, for detecting the presence/absence of the original on the placing table, an open/closed detection unit for detecting an open/closed state of the pressing member, and a judging unit for judging whether or not the original is placed on the placing table, on the basis of an output from the original detection unit obtained when the open/closed detection unit detects that the pressing member is in an open state and an output from the original detection unit obtained when the open/closed detection unit detects that the pressing member is in a closed state.

27 Claims, 13 Drawing Sheets

ORIGINAL DETECTION APPARATUS

BACKGROUND OF THE INVENTION:

1. Field of the Invention

The present invention relates to an apparatus for detecting an original using a light-emitting element and a light-receiving element.

2. Related Background Art

Conventionally, as a document detection apparatus provided to an original size detection apparatus for a copying machine, one disclosed in U.S. patent application Ser. No. 930,911, and the like is known. More specifically, in order to detect an original placed on an original glass, this apparatus has a plurality of detection units each consisting of a light-emitting element, arranged above an original glass, for illuminating an original and a light-receiving element, arranged below the original glass for receiving light reflected by the original. In general, an original size is detected in accordance with outputs from the detection units at three positions on an original table.

FIG. 1 shows a conventional apparatus. A sensor 110 is a reflection type sensor including a light-emitting element such as an LED and a light-receiving element such as a photodiode. The sensor 110 emits light upward, and detects light reflected by an original 102 placed on an original glass 101, thereby detecting the presence/absence of an original.

In this case, in each detection unit, a gain (amplification factor) of the light-receiving element is adjusted to determine the presence of an original when it receives reflected light exceeding a predetermined level. An original size is detected in accordance with the presence/absence of an original at the respective points (three points).

However, in the conventional image forming apparatus, since the gain of the light-receiving element is fixed in advance, the presence/absence of an original may often be erroneously detected due to temperature characteristics of the light-emitting element and the light-receiving element or a variation in characteristics of individual elements.

Note that Japanese Patent Application No. 62-28442 discloses a technique in which in order to determine the presence/absence of an original, the original is exposed with an exposure lamp, light reflected by the original is read by a CCD, and a slice level for binarizing the output from the CCD is adjusted. However, this application does not disclose an arrangement in which a plurality of detection units each including a pair of a light-emitting element and a light-receiving element are arranged, and sensitivity of the light-receiving element of each detection unit is adjusted.

The sensor 110 in FIG. 1 receives light reflected by the original 102 to perform a detection operation of an original. For this reason, if a detection portion 102-A of the original 102 includes an image having a high density (e.g., black image), the sensor erroneously determines the absence of an original. If detection power of the sensor (light-receiving unit) is increased to detect a dark original as much as possible, a pressing plate 103 above the original glass may be detected or a detection error may be caused due to detection of external light if an original is absent.

SUMMARY OF THE INVENTION

It is an object of the present invention to provide an original detection apparatus which can reliably detect the presence/absence of an original regardless of a density of an original.

It is another object of the present invention to provide an original size detection apparatus which can reliably detect an original size regardless of a density of an original.

It is still another object of the present invention to provide an original detection apparatus which can easily correct characteristics of an original detection element, and can reliably detect the presence/absence of an original.

It is still another object of the present invention to provide an original detection apparatus which can prevent a detection error of an original size caused by a variation in characteristics of each detection element in an apparatus for detecting an original size on the basis of outputs from a plurality of original detection elements.

The above and other objects of the present invention will be apparent from the following description taken in conjunction with the accompanying drawings.

DETAILED DESCRIPTION OF THE PREFERRED EMBODIMENTS

An embodiment of the present invention will now be described with reference to the accompanying drawings.

Figure 2:
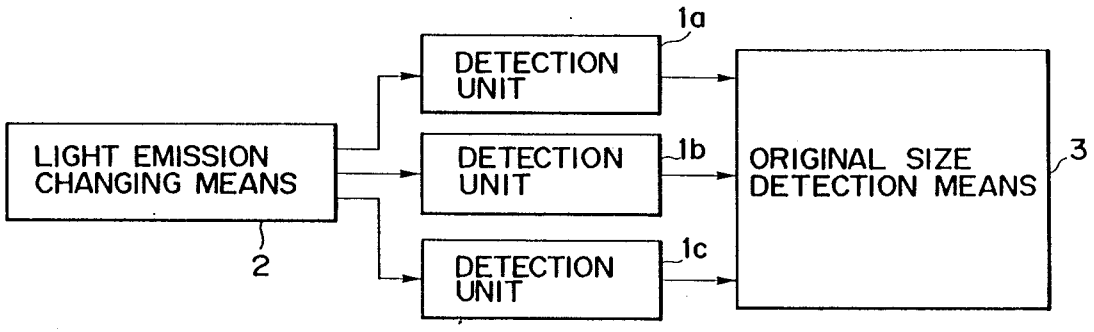
FIG. 2 is a block diagram of an original size detection system of an image forming apparatus according to the present invention.

FIG. 2 is a block diagram showing an arrangement of an original size detection system of an image forming apparatus according to the present invention. In FIG. 2, each of a plurality of (three in this embodiment) detection units 1*a*, 1*b*, and 1*c* has a light-emitting element for illuminating an original, and a light-receiving element for receiving light reflected by an original. A light emission changing means 2 causes the light-emitting elements of the detection units 1*a*, 1*b*, and 1*c* to emit light pulses, and can change the frequency of the pulses. An original size detection means 3 detects a size of an original on the basis of outputs from the light-receiving elements of the detection units 1*a*, 1*b*, and 1*c*.

Figure 3:
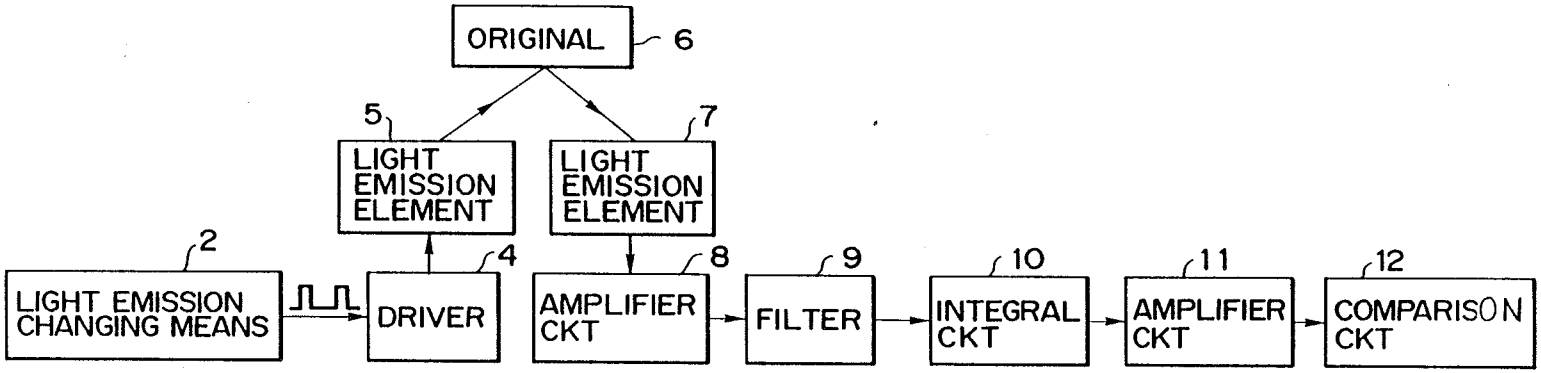
FIG. 3 is a block diagram showing in detail an original size detection means shown in FIG. 2.

FIG. 3 is a block diagram showing in detail the original size detection means. In FIG. 3, each detection unit comprises a driver 4 for causing a light-emitting element 5 to emit light in response to pulses from the light emission changing means 2, an original 6, and a light-receiving element 7. The original size detection means comprises an amplifier 8 for amplifying an output from the light-receiving element 7, a filter 9 for cutting a DC (direct current) component from the amplified signal, an integral circuit 10 for converting an output pulse value from the filter 9 into a DC voltage value, an amplifier 11 for amplifying the voltage value, and a comparator 12 for comparing the amplified voltage value with a threshold value. Note that gains of the amplifiers 8 and 11 are fixed values.

In the above-mentioned original size detection system, the gains of the amplifiers 8 and 11 shown in FIG. 3 are fixed in advance like in the conventional apparatus. The light-emitting elements 5 of the detection units 1*a*, 1*b*, and 1*c* emit light pulses by the light emission changing means 2, and the frequency of the pulses can be varied by the light emission changing means 2. For this reason, an instantaneous amount of light (luminance) can be increased as compared to DC light emission, and an error caused by temperature characteristics of the light-emitting elements 5 and the light-receiving elements 7 or a variation in characteristics of individual elements can be easily corrected by an operation at an operation unit of the apparatus. Therefore, the size of the original 6 can be prevented from being erroneously detected.

Figure 4:
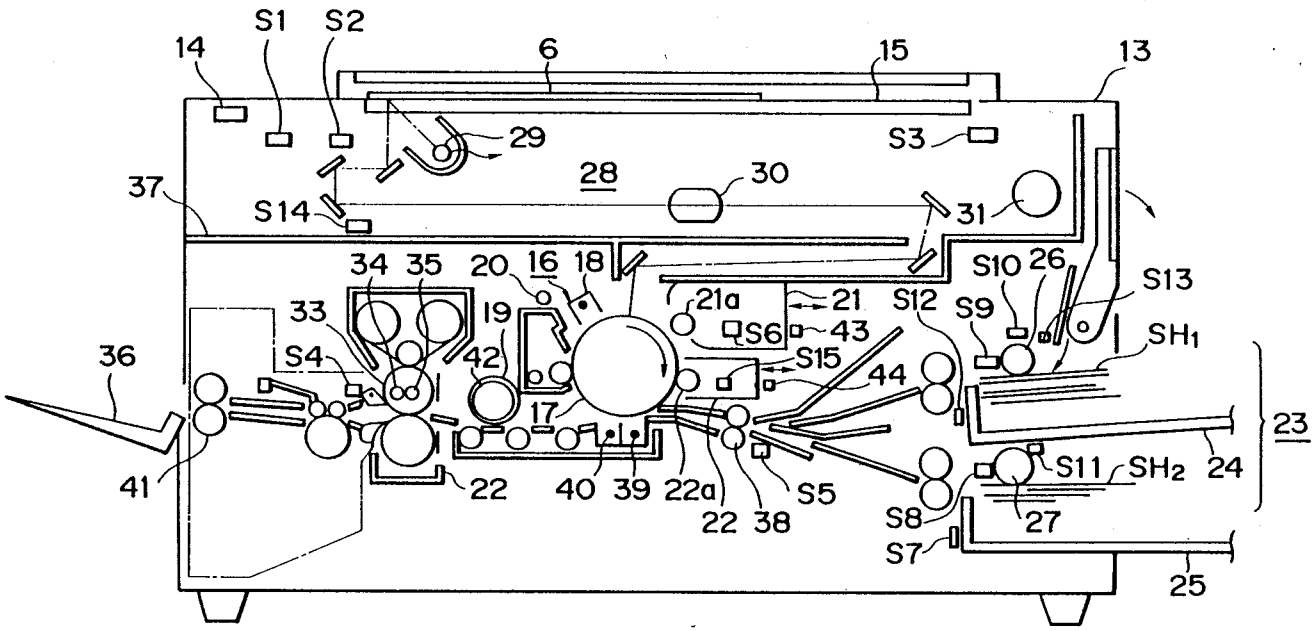
FIG. 4 is a schematic sectional view of a copying machine having the detection system shown in FIG. 2.

FIG. 4 shows a schematic arrangement of a copying machine having the original size detection system shown in FIG. 2. The copying machine, shown in FIG. 2, includes a copying machine main body 13, a power switch 14, an original table 15 for placing the original 6 thereon, and an image forming section 16, which has a charger 18, a cleaner 19, an erase lamp 20, and the like, arranged around a photosensitive drum 17. Developing units 21 and 22 respectively store red and black toners, and comprise developing rollers 21*a* and 22*a*. A sheet feed section 23 feeds transfer sheets $SH_1$ and $SH_2$ into the main body 13, and comprises detachable cassettes 24 and 25, and sheet feed rollers 26 and 27. An optical system 28 exposes and scans the original 6 with an exposure lamp 29 to form an original image on the photosensitive drum 17, and has a lens system including a focusing lens 30. The copying machine also includes an optical motor 31 for moving the optical system 28, a fixing unit 32 having fixing rollers 33, heaters 34 and 35, an exhaust tray 36, a base 37 on which the detection units 1*a*, 1*b*, and 1*c* shown in FIG. 2 are placed, sheet feed rollers 38, a charger 39, a peeling charger 40, exhaust rollers 41, a main motor 42 for driving the photosensitive drum 17, compression solenoids 43 and 44, and optical sensors $S_1$ and $S_{15}$ arranged at respective portions.

Figure 5:
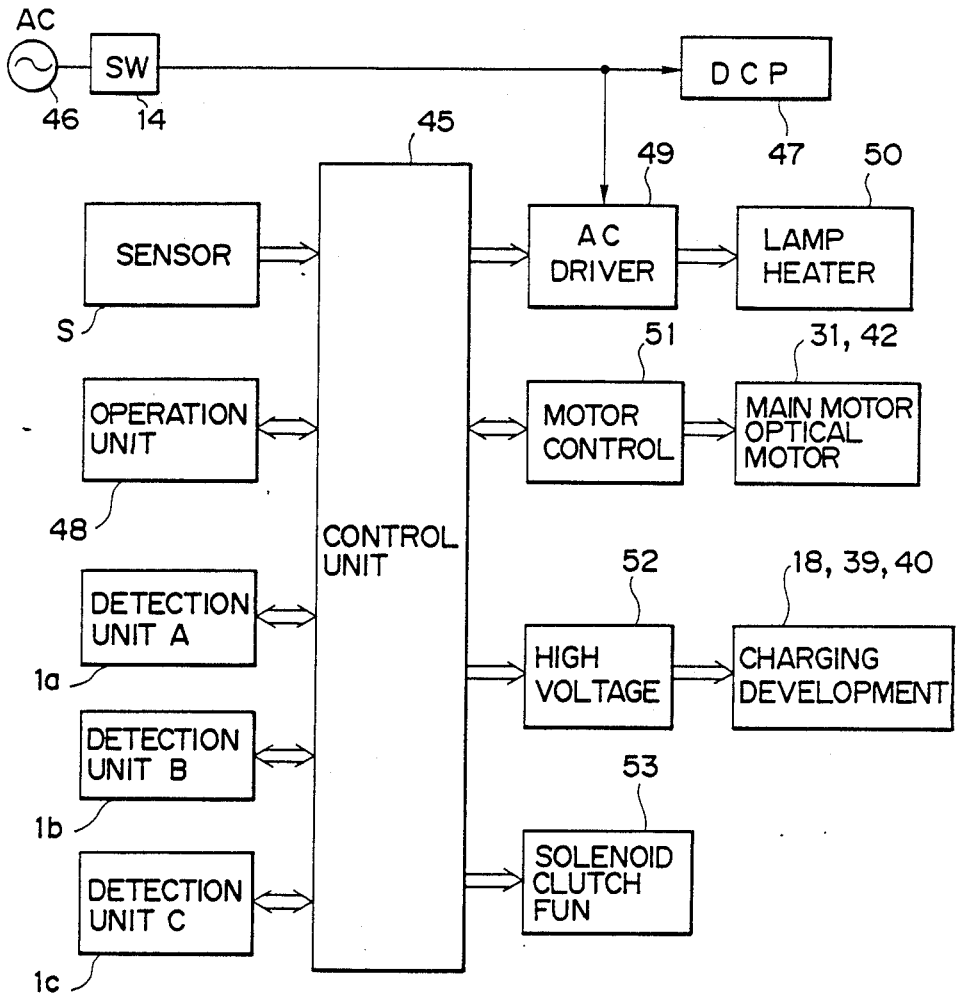
FIG. 5 is a control block diagram of the copying machine shown in FIG. 4.

FIG. 5 is a control block diagram of the copying machine. In FIG. 5, a control unit 45 includes the light emission changing means 2 and the original size detection means 3 shown in FIG. 2. Although not shown, the control unit 45 comprises a CPU, and a ROM storing control program data, and controls the entire machine. The control system shown in FIG. 5 includes a DC power supply (DCP) 46 for supplying power to the control unit 45, and the like, a sensor group S shown in FIG. 4, an operation unit 48, an AC driver 49, serving as a controller for AC loads, for controlling the control unit 45, and AC loads 50 such as the lamp 29, heaters 34 and 35, and the like, a motor control unit 51 for controlling the optical motor 31 and the main motor 42, a high voltage generator (HVT) 52 for supplying a high voltage to the chargers 18, 39, and 40, and the developing units 21 and 22, and loads 53 such as solenoids, a clutch, a fan, and the like.

The operation of the above-mentioned copying machine will be described below.

When the power switch 14 is turned on, the heaters 34 and 35 in the fixing unit 32 are heated, and it is waited until the fixing rollers 33 reach a predetermined temperature capable of a fixing operation. When the fixing rollers 33 reach the predetermined temperature, the main motor 42 is energized for a predetermined period of time to drive the photosensitive drum 17, the fixing unit 32, and the like, thereby uniforming the temperature of the rollers 33 in the fixing unit 32. Thereafter, the main motor 42 is stopped, and it is waited in a copy enable state. The main motor 42 drives the photosensitive drum 17, the fixing unit 32, the developing units 21 and 22, and various transfer sheet convey rollers. When a copy instruction is input from the operation unit 48, a copying operation is started.

DESCRIPTION OF IMAGE FORMATION

In response to the copy instruction, the main motor 42 is rotated to rotate the photosensitive drum 17 in a direction indicated by an arrow. A high voltage is supplied from the HVT 52 to the primary charger 18 to uniformly charge the photosensitive drum 17. The exposure lamp 29 is then turned on, and the optical motor 31 is driven to expose and scan the original 6 placed on the original table 15 in a direction of an arrow, thereby projecting an original image onto the photosensitive drum 17. Thus, an electrostatic latent image of the original 6 is formed on the photosensitive drum 17. The latent image is developed by the developing unit 21 or 22, and is transferred onto the transfer sheet $SH_1$ or $SH_2$ by the transfer charger 39. The sheet is separated from the photosensitive drum 17 at a portion of the peeling charger 40. Residual toner on the photosensitive drum 17 is cleaned by the cleaner 19, and the surface of the drum 17 is uniformly discharged by the erase lamp 20. Thereafter, a copying cycle is repeated. In this case, one of the first and second developing units 21 and 22 is brought into contact with the photosensitive drum 17 in accordance with a selection instruction from the operation unit 48. For example, the first developing unit 21 stores a red toner to serve as a color developing unit, and the second developing unit 33 stores a black toner to serve as a black developing unit. Pressing (contact) and releasing of these developing units 21 and 22 to and from the drum 17 are performed by the corresponding solenoids 43 and 44. When the solenoid 43 is energized, the red developing unit 21 is released from the drum 17, and when the solenoid 44 is energized, the black developing unit 22 is pressed against the drum 17. In the developing units 21 and 22, a black toner sensor $S_{15}$ and a color toner sensor $S_6$ are respectively arranged, and the developing rollers 21*a* and 22*a* of the developing units 21 and 22 are applied with a developing bias voltage from the HVT 52.

The optical system 28 is reciprocated by rotating the main motor 42 in a forward or reverse direction through the motor control unit 51 in accordance with an instruction from the control unit 45. The sensor $S_1$ is arranged as a home position sensor of the optical system 28. In a standby state, the sensor $S_1$ stands still at the illustrated position. The sensor $S_2$ serves as an image tip sensor corresponding to a leading end position of an original image, and is used for taking a timing of copy sequence control. The sensor $S_3$ serves as a limiter position (reverse position) detection sensor. The optical system 28 is reciprocally moved by a scan length according to a cassette size and a copying magnification in response an instruction on the basis of a size detected by the original size detection means (to be described later).

DESCRIPTION OF OPERATION UNIT

An operation of the operation unit 48 will be described.

Figure 6:
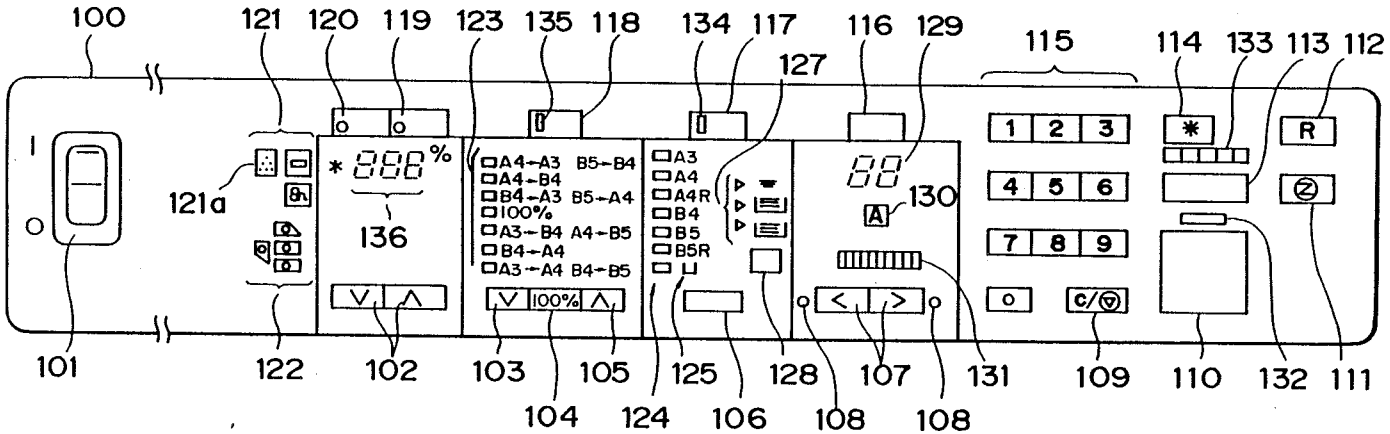
FIG. 6 is a view showing an outer appearance of an operation panel of an operation unit shown in FIG. 5.

FIG. 6 shows an outer appearance of an operation panel 100 of the operation unit 48. The operation panel 100 includes a power switch 101 for controlling energization of the copying machine main body 13, a zoom or up-down key 102 for designating an arbitrary magnification in units of, e.g., 1%, a reduction key 103 for instructing a given reduction magnification, a key 104 for selecting an equal magnification copy mode, an enlargement magnification key 105 for instructing a given enlargement magnification, a key 106 for selecting a cassette, keys 107 for adjusting a copy density, and density correction keys 108 for changing a copy density designated by the copy density adjustment keys 107. In this embodiment, a turn-on voltage of the exposure lamp 29 is controlled by the copy density adjustment keys 107 to adjust a copy density, and a developing bias is changed by the copy density correction keys 108 to change the copy density. The operation panel 100 also includes a clear/stop key 109 which serves as a copy stop key during execution of a copying operation, a copy key 110, a preheat key 111, a key 112 for restoring a standard mode, a color selection key 113 for switching between the developing units 21 and 22, an asterisk key 114 which is used when the length of the original 6 and a desired length after the copying operation are input to select a corresponding magnification, a ten-key pad 115 for inputting a copy count, an AE key 116 for designating an automatic density adjustment mode, a key 117 for designating an automatic sheet selection mode for selecting an optimal transfer sheet in accordance with an original size detected by the original size detection means (to be described later) and a designated copying magnification, a key 118 for designating an automatic magnification selection mode for selecting an optimal magnification in accordance with the original size detected by the original size detection means (to be described later) and a designated transfer sheet size, a key 119 for calling a magnification set in a memory, a key 120 for registering a magnification in the memory, an alarm indicator 121 indicating a toner empty state, control counter disable state, and paper jam state, an asterisk key 122, an LED 114 which is turned on upon calculation of a magnification, LEDs 123 which indicate a designated magnification mode and is designated by the keys 103 and 105, LEDs 124 indicating a cassette used for a copying operation, and an LED 125 indicating a loaded cassette. For example, when an A3 cassette is loaded as an upper cassette and an A4 cassette is loaded as a lower cassette and the lower cassette is selected, cassette indication LEDs corresponding to the A3 and A4 are turned on, and one of the LEDs 124 corresponding to the A4 is turned on. The operation panel 100 also includes LEDs 127 indicating one of a manual feed unit and the upper and lower cassettes, an LED 128 which is turned on when sheets in the cassettes are used up or no cassette is loaded, an LED 129 indicating a copy count, an LED 130 indicating an automatic density adjustment mode, a density indication LED 131, a standby indication LED 132 which is turned on in green in a copy enable state and is turned on in red in a copy disable state, LEDs 133 indicating a color of a designated developing unit, an indicator 134 indicating an automatic sheet selection mode, and an LED 135 indicating an automatic magnification selection mode. Note that an indicator **121*a* indicating a toner empty state indicates whether or not a developing unit designated by the developing unit switching selection key 113 stores a toner. More specifically, when a black toner is used up, the indicator 121*a* is turned on only when the black developing unit 22 is selected, and is kept off when the color developing unit 21** is selected, and vise versa.

Correction on the basis of a variation in characteristics of the light-emitting elements 5 and the light-receiving elements 7 can be easily performed on the operation panel 100 by changing the frequency of pulse light emission of the light-emitting elements. In this case, a dark original 6 having a critical density with which the presence of an original can be determined is placed on the original table 15 above the detection units **1*a*, 1*b*, and 1*c*, and the detection units 1*a*, 1*b*, and 1*c* are adjusted on the operation panel 100 while the original pressing plate is opened. In this case, when the detection units 1*a*, 1*b*, and 1*c* output signals indicating the presence of an original, the AE mode indicator 130 on the operation panel 100 is turned on, and when they output signals indicating the absence of an original, the indicator 130** is turned off. Thus, an original size can be detected.

Figure 7:
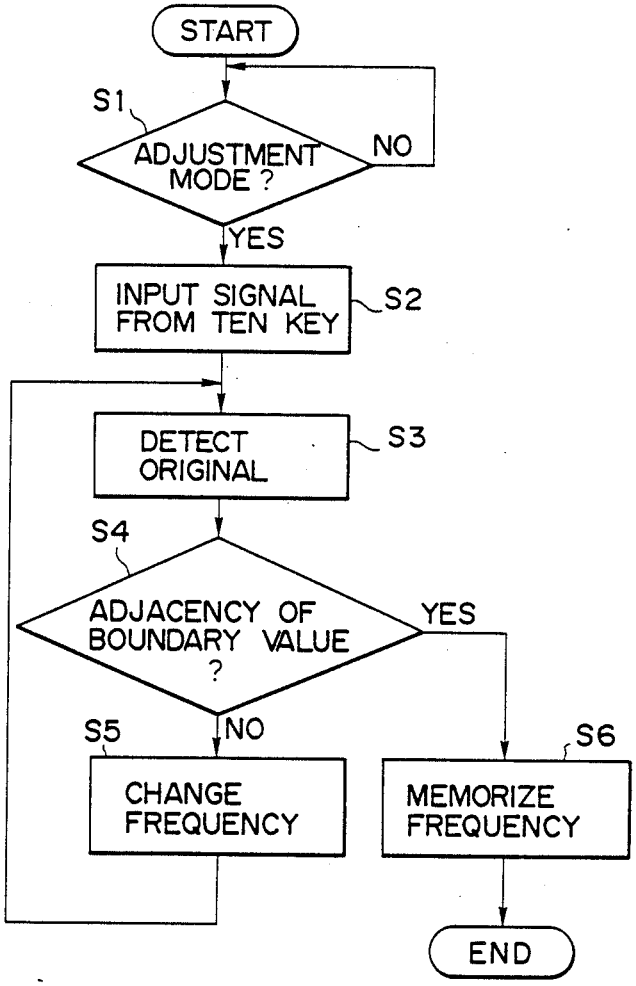
FIGS. 7 and 8 are flow charts showing adjustment operations of a detection unit.

FIG. 7 is a flow chart schematically showing an adjustment operation of the detection units.

When the asterisk key 114, a key "1", a key "0", and the asterisk key 114 are operated in this order on the operation panel 100 in step S1, it is determined that a adjustment mode of the detection units 1 is selected. In step S2, a signal (number, e.g., "11") for performing adjustment of the detection unit **1*a* is input by the ten-key pad 115, and then, the asterisk key 114 is depressed. In this case, the input number "11" is displayed on the LED 129, and a set drive frequency of the selected light-emitting element 5 is displayed o the LED 136. The light-emitting element 5 emits light pulses at this drive frequency, light reflected by the original 6 is received by the light-receiving element 7, and the presence/absence of the original is detected by the original size detection means 3 in step S3. It is checked in step S4 if the level of the signal indicating the presence/absence of the original is adjacent to a boundary value with which the presence of an original can be detected. If NO in step S4, the drive frequency of the light-emitting element 5 is increased, and original detection is performed again in step S3. If YES in step S4, the frequency at that time is stored in step S6, thus completing adjustment of the detection unit 1*a***.

The remaining detection units **1*b* and 1*c*** and can be similarly adjusted by inputting "12*" and "13*" in step S2. In this case, the control unit 45 includes a table of frequency data of the detection units **1*a*, 1*b*, and 1*c*, so that the three detection units 1*a*, 1*b*, and 1*c*** can be adjusted to the detection sensitivity level.

The frequency of pulses of each light-emitting element can be manually adjusted. More specifically, after the frequency is displayed on the indicator 136, the up-down key 102 is operated to change the frequency from the displayed value. In this case, since the corresponding detection unit is operating, the up-down key 102 is operated while observing a response on the AE indicator 132. When the signal indicating the presence/absence of an original from the detection unit reaches a level adjacent to a boundary value capable of detecting the presence of an original, adjustment is ended.

In this embodiment, adjustment by changing a frequency has been exemplified without changing a duty ratio of pulse light emission. However, adjustment can be made by changing a duty ratio while the drive frequency of the light-emitting element 5 is left unchanged, and the same effect can be obtained.

In the above embodiment, the drive frequency of the light-emitting element is changed. Next, a case will be described below wherein a level of judging the presence of an original is changed.

Figure 8:
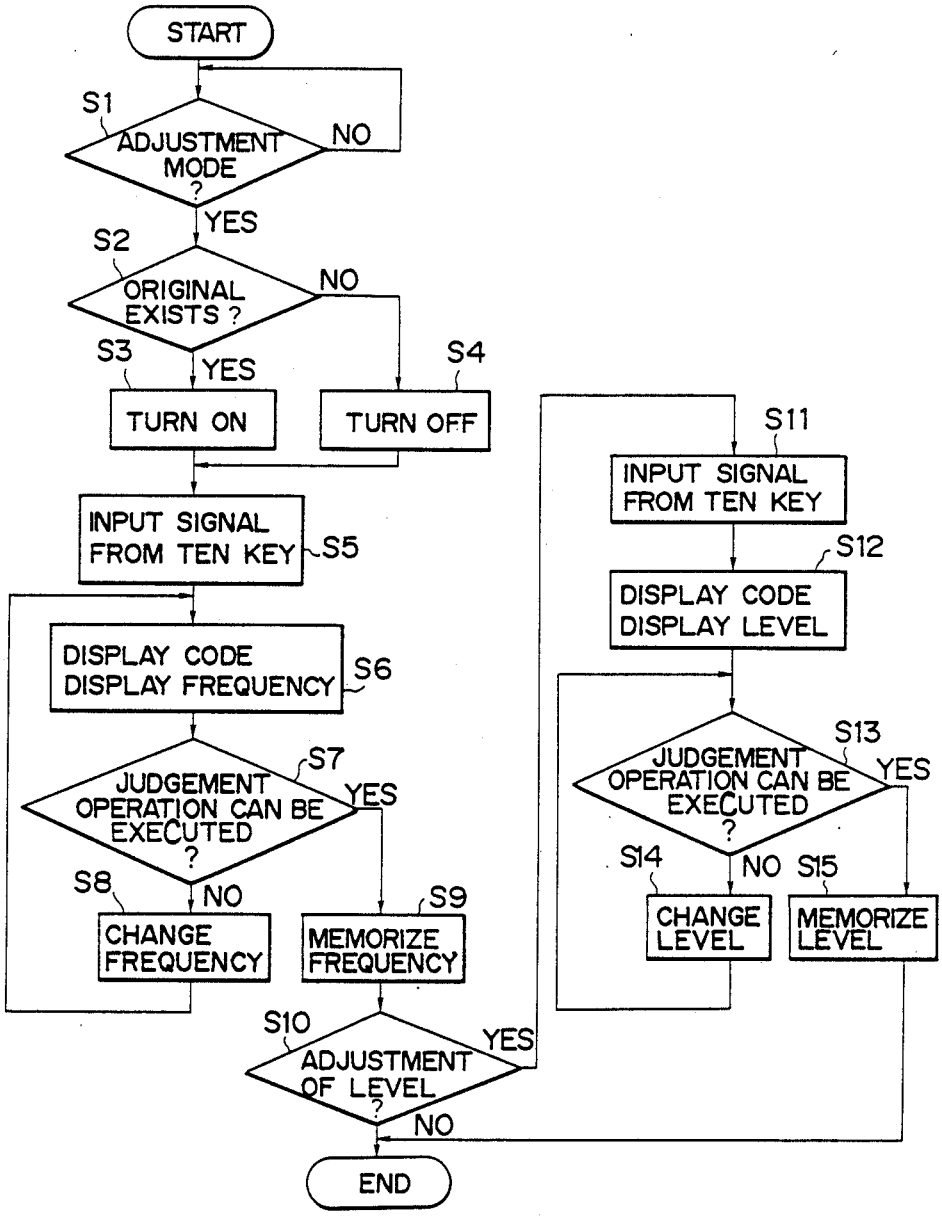

FIG. 8 is a flow chart schematically showing an adjustment operation of the detection unit.

When keys on the operation panel 100 are depressed in the order of the asterisk key 114, the key "1", the key "1", and the asterisk key 114, it is determined in step S1 that the adjustment mode of the detection units 1 is selected. It is then checked in step S2 on the basis of the outputs from the detection units 1 if an original exists. If YES in step S2, the LED 130 on the operation unit 100 is turned on in step S3; if NO in step S2, it is turned off in step S4. In step S5, a signal (code; e.g., "11") for performing adjustment of a pulse light emission frequency of the detection unit 1*a* is input by the ten-key pad 115, and then, the asterisk key 114 is depressed. In this case, the input code "11" is displayed on the LED 129, and a pulse light emission frequency corresponding to the light-emitting element of the detection unit 1*a* is displayed on the LED 136.

Upon completion of above setting, the light-emitting element of the detection unit 1*a* emits light pulses at the frequency displayed on the LED 136 to detect an original. In this case, a dark original having a critical density with which the presence of an original can be determined is placed on the original table 15. It is checked in step S7 in accordance with the light from the light-emitting element if a judgement operation of the presence of an original can be executed. If NO in step S7, the pulse light emission frequency of the light-emitting element of the detection unit 1*a* is automatically decreased by a predetermined amount, and the changed frequency is displayed on the LED 136. This operation is repeated until it is determined that the judgement operation can be executed. Note that the duty ratio of the pulse is left unchanged. The light emission frequency when the presence of the original can be judged is stored in the memory of the control unit 45 in step S9. If it is determined in step S10 that an adjustment mode of the judgement level is not set, the adjustment of the pulse light emission frequency of the detection unit 1*a* is completed.

If it is determined in step S10 that the judgement level is to be adjusted, a signal (code; e.g., "21") for performing adjustment of a level of the detection unit 1*a* is input by the ten-key pad 115, and then, the asterisk key 114 is depressed. In this case, the code "21" is displayed on the LED 129, and the judgement level of the presence/absence of an original for the detection unit 1*a* is displayed on the LED 136. Upon completion of above setting, the same operations as in steps S7 to S9 are executed. More specifically, original detection is performed at the above-mentioned judgement level. In this case, a dark original having a critical density capable of judging an original is placed on the original table 15. It is checked in step S13 if the presence of an original can be judged. If NO in step S13, the judgement level is automatically decreased by a predetermined amount, and the changed level is displayed on the LED 136, in step S14. This operation is repeated until the presence of an original can be judged. That is, a slice level for binarization of the comparator 12 is lowered. If YES is obtained in step S13, the judgement level value at that time is stored in the control unit 45 in step S15. Thus, adjustment of a light emission frequency and adjustment of a judgement level are completed.

The adjustment can be similarly performed for the remaining detection units 1*b* and 1*c* by inputting "12*" and "13*" in step S5 and "22*" and "23*" in step S11. In this case, the control unit 45 has a table storing frequency data and judgement level of the detection units 1*a*, 1*b*, and 1*c* so that the detection sensitivities of the three detection units 1*a*, 1*b*, and 1*c* can be adjusted to the same level. The light-emitting elements of the adjusted detection units 1*a*, 1*b*, and 1*c* always emit light pulses. The outputs from the detection units 1*a*, 1*b*, and 1*c* immediately before the pressing plate (cover of the original table 15) is closed are fetched in the control unit 45 so as to detect the size of the original 6.

In this embodiment, the judgement level of original detection and the pulse light emission frequency are adjusted using keys such as the ten-key pad, and display LEDs. A touch panel as a combination of liquid-crystal displays and transparent switches can be arranged to facilitate key operations for adjustment and to shorten a adjustment time and the like.

In the above embodiment, the judgement level of original detection is adjusted by changing it by, e.g., software volume control. However, the judgement level may be changed by hardware volume control. In this case, the outputs from the three detection units are connected to an A/D conversion input unit of a microcomputer, and corresponding hardware volume controls are similarly connected to the A/D conversion input unit of the microcomputer. The presence/absence of an original can be judged using the setting values of the corresponding hardware volume controls in accordance with the output values of the detection units.

In the above embodiment, the detection units 1*a*, 1*b*, and 1*c* are selected and adjusted one by one. However, the three detection units may be automatically and continuously adjusted.

In this case, in FIG. 8, the flow jumps from step S9 to step S11, and then, the flow jumps from step S15 to step S2. This operation can be repeated until the adjustment of the detection unit 1*c* is completed.

The frequency may be manually adjusted in step S8, and the judgement level may be manually adjusted in step S14 in the same manner as in the above embodiment. More specifically, the frequency displayed on the LED 136 is changed by operating the up-down key 102, and the color key 113 is depressed while observing the response on the AE indicator 132, so that the frequency at that time is stored in the control unit. In step S14, the judgement level displayed on the LED 136 is changed while observing the AE indicator 132, and the color key 113 is then depressed so that the frequency at that time is stored in the control unit.

As described above, the analog output level of the light receiving element is judged by the original size detection means to detect an original size, and its judgement level can be changed. Therefore, an error caused by temperature characteristics of the light-emitting elements and the light-receiving elements or a variation in characteristics of individual elements can be easily corrected later, thus preventing a detection error of an original size.

Since the light-emitting elements emit light pulses, a detection error caused by disturbance light can be prevented, and when their light emission frequencies are variable, an error correction can be reliably performed.

When a portion of an original irradiated with light from the light-emitting element 5 has a high density, an amount of light incident on the light-receiving element 7 is decreased, and the absence of an original may be erroneously judged. A method of preventing such a detection error will be described below.

Figure 1:
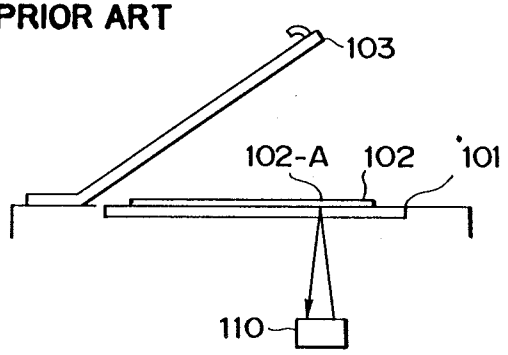
FIG. 1 PRIOR ART
FIG. 1 a view showing a conventional original detection apparatus.
Figure 9A:
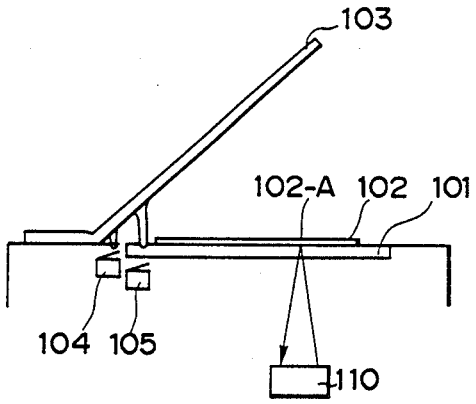
FIGS. 9A and 9B and FIGS. 12A and 12B are views showing arrangements of an apparatus according to the present invention.
Figure 9B:
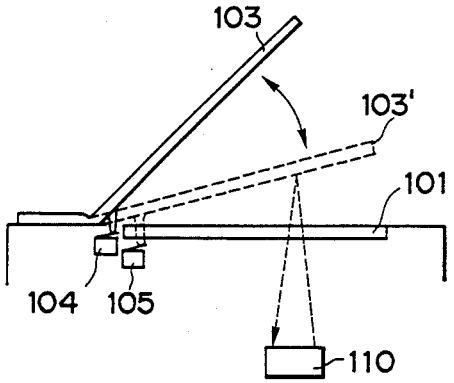
Figure 10:
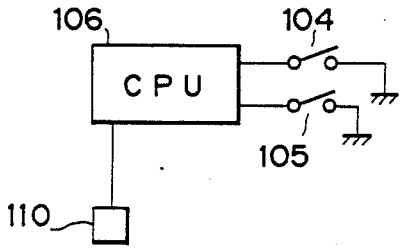
FIGS. 10 and 13 are control block diagrams.

FIGS. 9A and 9B are views showing an arrangement of this embodiment, and FIG. 10 is a block diagram thereof. In FIGS. 9A and 9B and FIG. 10, an original 102 to be copied is placed on an original glass 101, and an original pressing plate 103 presses the original 102 placed on the original glass 101. The surface of the original pressing plate 103 facing the original glass is colored in white. Switches 104 and 105 detect angles of the pressing plate 103 with respect to the glass 101 and generate timing signals of detection of the presence/absence of an original. The switch 104 detects a pressing plate open state, and the switch 105 detects a pressing plate closed state. The switches 104 and 105 are connected to a control CPU 106. Note that 103' indicates a position where the pressing plate 103 causes the switch 105 to operate. A detection unit 110 comprises the same reflection type sensor as in the prior art shown in FIG. 1 and that in FIG. 2. FIG. 9A illustrates a state wherein the original 102 is placed on the original glass, and FIG. 9B illustrates a state without an original.

An original detection operation in the above arrangement will now be described. FIG. 9A shows a state wherein the original 102 is placed on the original glass 101. In FIG. 9A, a light-emitting element of the sensor 110 always emits light upward, and a light-receiving element thereof receives light reflected by the original 102, thereby detecting the presence of the original 102. When an image of a portion 102-A to be detected of the original 102 has a high density, almost no reflection by the original 102 occurs, and the absence of an original is detected. On the other hand, the switches 104 and 105 respectively detect the open and closed states of the original pressing plate 103. When a lever interlocked with the pressing plate 103 turns on the switch 104, the open state of the pressing plate is detected, and a timing signal is generated. Similarly, when the lever turns on the switch 105, the closed state of the pressing plate is detected, and a timing signal is generated. When the original 102 is placed as shown in FIG. 9A, the output from the sensor 110 can be obtained in accordance with the original density regardless of the ON state of the switch 104 or 105 (the position of the pressing plate 103). When no original is placed as shown in FIG. 9B, that is, when the pressing plate is released or when the switch 104 is turned on and the switch 105 is turned off, the sensor 110 does not receive reflected light. When the pressing plate 103 is set in a closed state, i.e., it is closed to an angle at which the switch 105 is turned on, the sensor 110 receives light reflected by the pressing plate 103', and the presence of a white original is detected as in FIG. 9A. The table below summarizes these states.

TABLE 1

| Original | Pressing Plate Open | Pressing Plate Closed |
|---|---|---|
| Absence | x | o |
| White (low density) | o | o |
| Black (high density) | x | x |

o . . . presence of light reception;
x . . . absence of light reception

More specifically, when no original is placed, the light reception state of the sensor 110 is changed depending on the open/closed state of the pressing plate 103. When the original is white, light can be received in both the open and closed states, and when the original is black, no light is received in both the open and closed states. In other words, if the light reception states in both the open and closed states are the same, the presence of an original can be judged. As can be seen from this table, when the output from the sensor 110 in the open state of the pressing plate 103 is combined with the output from the sensor 110 in the closed state, the presence/absence of even a black original can be detected.

Figure 11:
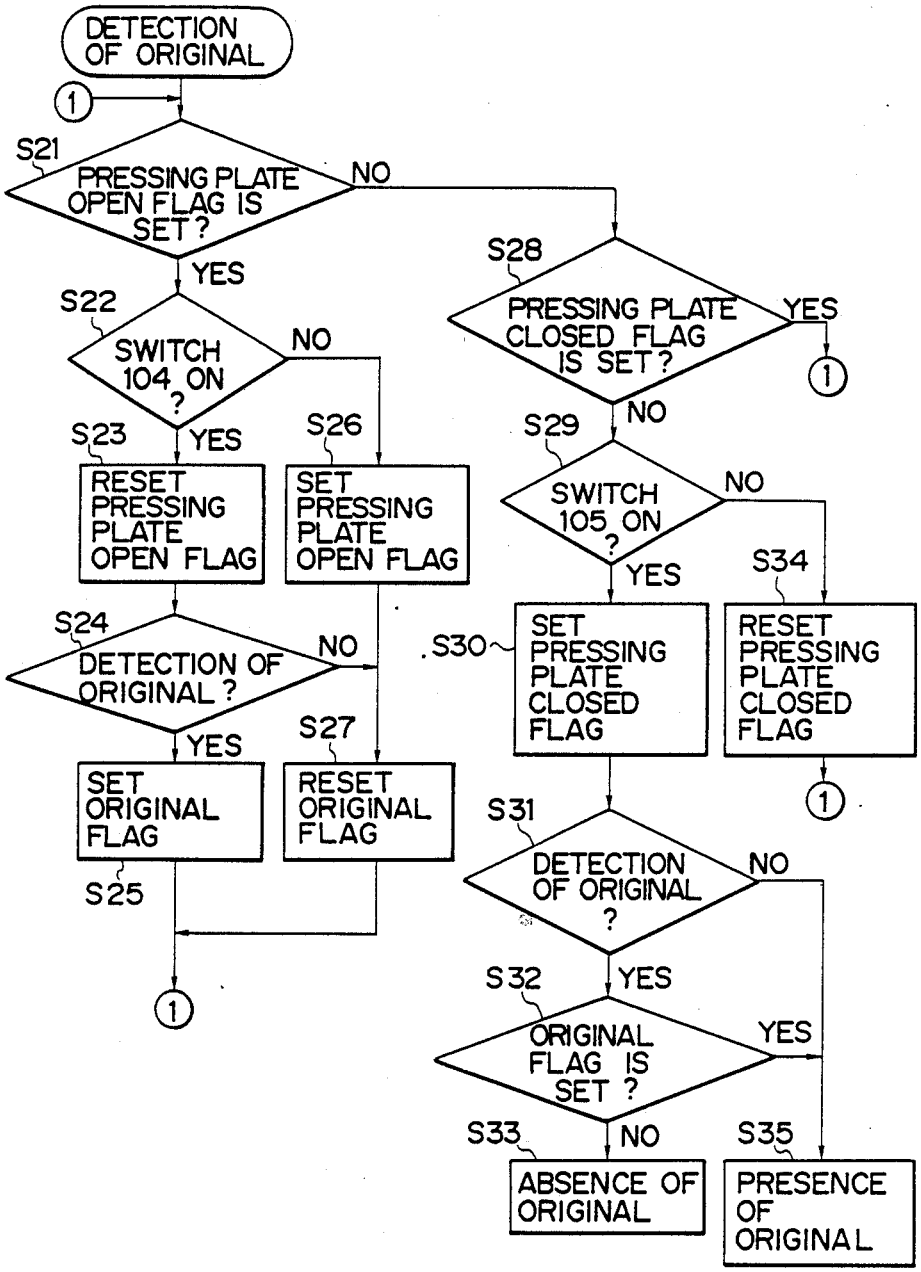
FIGS. 11 and 15 are flow charts showing original detection processing.

FIG. 11 is a flow chart showing detailed processing for detecting the presence/absence of an original. This processing will be described below. When neither the switch 104 nor 105 are turned on, a pressing plate open flag is set in step 26. When the lever of the pressing plate turns on the switch 104 as the pressing plate is being closed from the open state, the pressing plate open flag is reset (steps 21, 22, and 23). The light reception state of the sensor 110 at that time is judged (step 24). If YES in step 24, i.e., if it is determined that light is received by the sensor 110, an original flag indicating the presence of an original is set (step 25); otherwise, the original flag is reset (step 27). When the lever of the pressing plate turns on the switch 105 as the pressing plate is further closed, a pressing plate closed flag is set (steps 28, 29, and 30), and the presence/absence of light reception at the sensor 110 is judged in step 31. If YES in step 31, the state of the original flag when the switch 104 is turned on is checked in step 32. If the flag is set, the presence of the original is determined (step 35); otherwise, the absence of the original is determined (step 33). If NO in step 31, it is determined that an original has a high density, and the presence of the original is determined in step 35.

As described above, not only a normal original but also an original having a high density can be detected, thus allowing stable original detection.

Figure 12A:
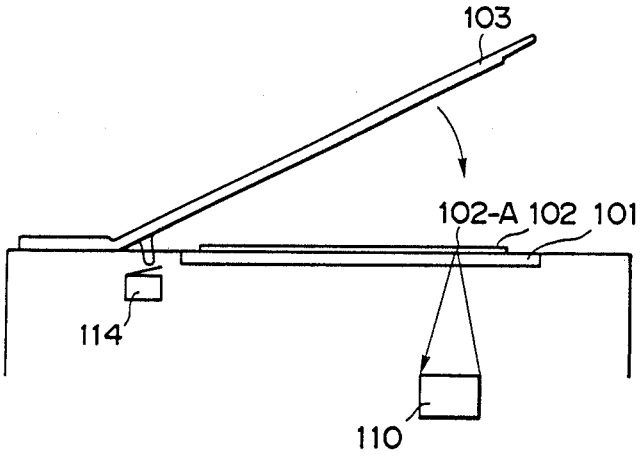
Figure 12B:
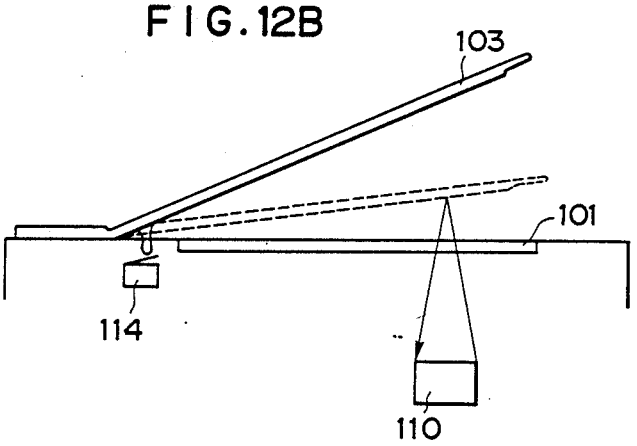
Figure 13:
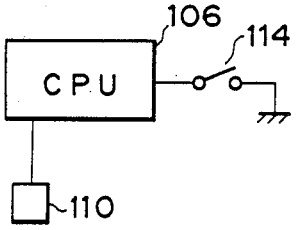

In the above embodiment, an original detection timing is taken by the two switches for detecting the open/closed state of the original pressing plate. Next, a method of taking an original detection timing using one switch will be described below. FIGS. 12A and 12 are views showing an arrangement according to the present invention, and FIG. 13 is a block diagram therefor. In FIGS. 12A and 12B and FIG. 13, an original 102 to be copied is placed on an original glass 101. An original pressing plate 103 presses the original 102 placed on the original glass 101. A switch 114 detects an angle of the pressing plate 103 with respect to the glass 101, and generates a timing signal for performing original detection. The switch 114 is connected to a control CPU 106. A reflection type sensor 110 is the same as that in the prior art. FIG. 12A shows a state wherein the original 102 is placed on the original glass, and FIG. 12B shows a state wherein no original is placed. An original detection operation with the above arrangement will be described below. FIG. 12A shows a state wherein the original 102 is placed on the original glass 101. In FIG. 12A, the sensor 110 emits light upward, and receives light reflected by the original 102, thereby detecting the original 102. When a portion 102-A to be detected of the original 102 has a high density, almost no reflection by the portion 102-A occurs, and the absence of the original is detected.

Figure 14A:
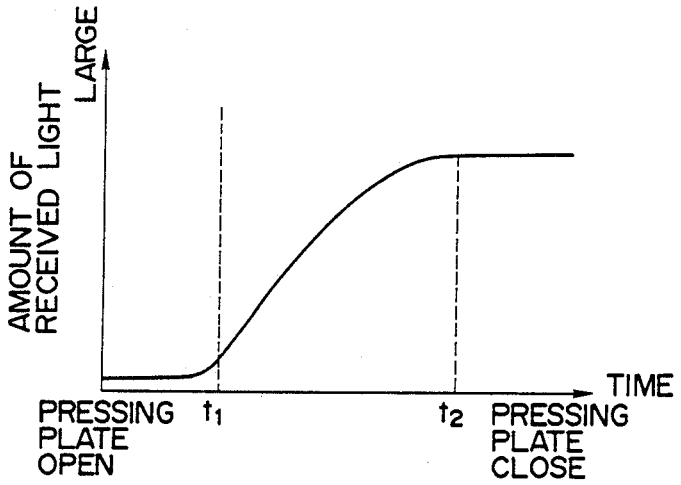
FIGS. 14A and 14B are graphs showing a change in amount of received light of a sensor.
Figure 14B:
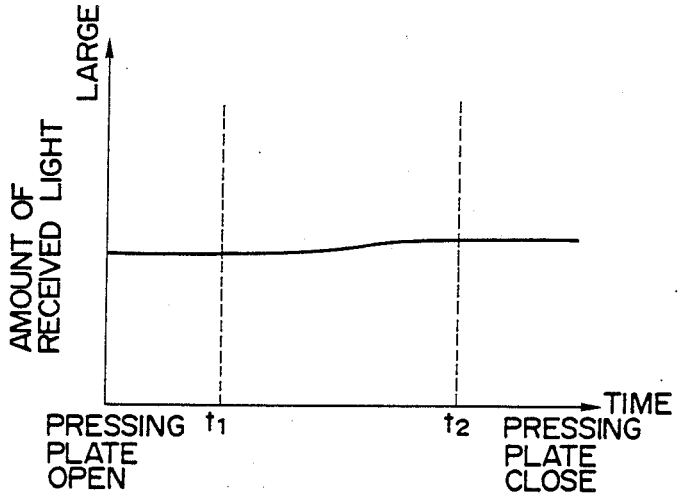

The switch 114 detects a closing operation of the pressing plate, and generates a timing signal for performing original detection. In a state wherein the original 102 is placed as shown in FIG. 12A, an amount of received light shown in FIG. 14B is obtained in accordance with the density of the original 102 regardless of the position of the pressing plate 103. In FIGS. 14A and 14B, $t_1$ indicates an ON timing of the switch 114, and $t_2$ indicates a timing after a time interval $T_2$ passes from $t_1$. Note that $T_2$ represents a time required from when the switch 114 is turned on until the pressing plate 103 is almost closed while the pressing plate 103 is changed from the open state to the closed state. The time interval $T_2$ is measured by an internal timer of the CPU. On the other hand, in a state wherein no original is placed on the glass table as shown in FIG. 12B, when the pressing plate is open, i.e., when the pressing plate is open at an angle more than an angle capable of operating the switch 114, the sensor does not receive light at all. When the pressing plate 103 is closed, light reflected by the pressing plate is received, and an amount of received light shown in FIG. 14A can be obtained in accordance with the state of the pressing plate. In general, the pressing plate is set from the open state to the closed state in a continuous operation. Therefore, when no original is placed, since the light reception state of the sensor 110 changes in accordance with the open/-closed state of the pressing plate 103, the amounts of received light at $t_1$ and $t_2$ shown in FIGS. 14A and 14B have a large difference. However, when an original is whitish or blackish, an amount of received light according to a density can be obtained. Therefore, the amounts of light at $t_1$ and $t_2$ almost no difference.

In this manner, the output from the sensor 110 when the switch 114 is switched from the OFF state to the ON state is combined with the output from the sensor 110 after the lapse of a predetermined time interval from the ON timing, the presence/absence of a blackish original can be detected.

Figure 15:
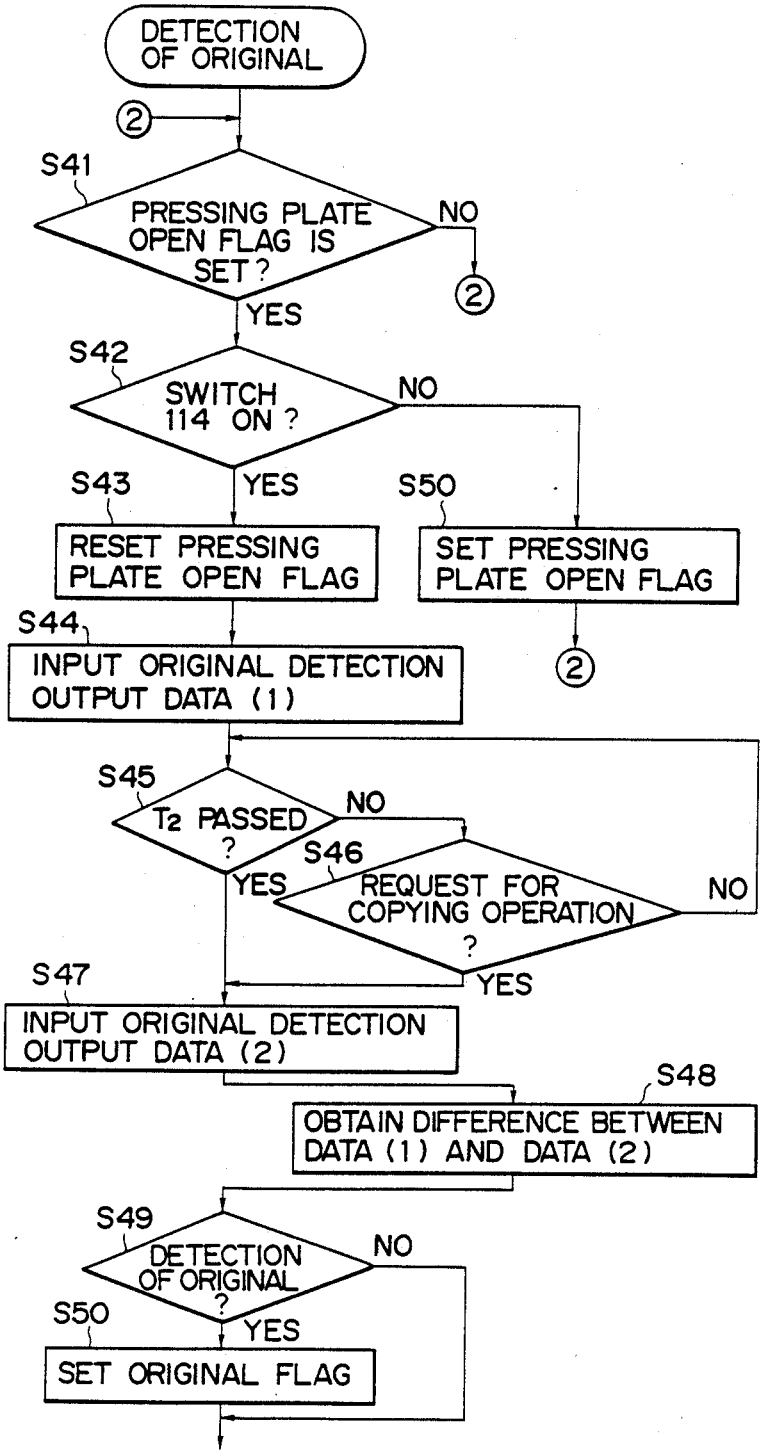

FIG. 15 is a flow chart showing detailed processing of detection of the presence/absence of an original described above. When the pressing plate is in the open state and does not actuate the switch 114, a pressing plate open flag is set in step 50. When the pressing plate 103 actuates the switch 114 as the pressing plate is being closed, the pressing plate open flag is reset (steps 41, 42, and 43), and the output from the sensor 110 at that time is read (step 44). After the pressing plate is further closed and a time interval $T_2$ passes after the switch 114 is actuated, the output obtained from the sensor 110 when a request for the copying operation (exposure operation) such as input of the copy button is detected is fetched (steps 45 to 47). A difference between data (1) fetched in step 44 and data (2) fetched in step 47 is calculated (step 48) so as to judge the presence/absence of an original (step 49). When the presence of an original is determined, an original flag is set (step 50).

More specifically, when no original is placed, since the difference between the data (1) and (2) is large, the absence of an original is determined. When an original is placed, since the difference between the data (1) and (2) is small regardless of the density, the presence of the original is determined.

As described above, not only a normal original but also a blackish original can be detected, thus allowing stable original detection.

In the above embodiment, a microswitch or the like is used for detecting an angle defined by the pressing plate 103 and the original glass 101. As an angle detection mechanism, a linear detection means such as a variable resistor which is moved integrally with an open/close operation of the pressing plate 103 or a single sensor may be employed to be switched from an ON state to an OFF state in accordance with the angle of the pressing plate.

The light-emitting element of the sensor 110 need not always emit light. The light-emitting element need only emit light for a while after the switch is closed, thus saving power consumption.

Figure 16:
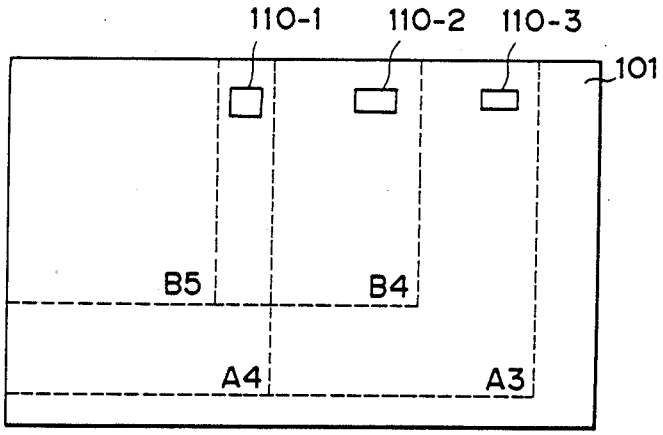
FIG. 16 is a view showing an arrangement when the present invention is applied to original size detection.

Original size detection utilizing the above embodiment will now be described. FIG. 16 is a top view of the upper surface of the original glass. In FIG. 16, sensors 110-1 to 110-3 are the same as those used in the original detection apparatus of the present invention. In FIG. 16, A3, A4, B4, and B5 represent original sizes. Although not shown in FIG. 16, the same pressing plate and pressing plate detection means as in the above embodiment are arranged. The presence/absence of an original is detected twice by the sensors 110-1 to 110-3 in accordance with the open/close operation of the pressing plate, thereby judging the presence/absence of the original. When the presence of an original is determined on the basis of the output from the sensor 110-1 and the absence of the original is determined on the basis of the outputs from the sensors 110-2 and 110-3, an A4 size can be determined; when the presence of the original is determined on the basis of the outputs from the sensors 110-1 and 110-2 and the absence of the original is determined on the basis of the output from the sensor 110-3, a B4 size can be determined; and when the presence of the original is determined on the basis of the outputs from the sensors 110-1, 110-2, and 110-3, an A3 size can be determined.

Note that the number and locations of sensors may be changed so that a larger number of original sizes can be judged.

When the drive frequency or judgement level of each sensor is adjusted, an original size can be detected with high accuracy.

When the sensors detect the absence of an original, the CPU can inhibit input by the copy key, thereby inhibiting a copying operation and informing the absence of an original to the operator.

As described above, signals from an original detection sensor at different timings, e.g., open and closed states of a pressing plate are combined, so that a blackish original which cannot be detected by the conventional apparatus can be easily detected.

The present invention is not limited to the above embodiments, and various changes and modifications may be made within the scope of the appended claims.

What is claimed is:

1. An original detection apparatus comprising:
a placing table for placing an original thereon;
an openable/closable pressing member for covering the original placed on said placing table;
original detection means, arranged below said placing table, for detecting a presence/absence of the original on said placing table;
open/closed detection means for detecting an open/-closed state of said pressing member; and
means for judging whether or not the original is placed on said placing table, on the basis of an output from said original detection means obtained when said open/closed detection means detects that said pressing member is in an open state and an output from said original detection means obtained when said open/closed detection means detects that said pressing member is in a closed state.

2. An apparatus according to claim 1, wherein an original pressing surface of said pressing member comprises a low-density member.

3. An apparatus according to claim 1, wherein said original detection means comprises a light-emitting element and a light-receiving element.

4. An apparatus according to claim 1, wherein said judging means judges a presence of the original when the detection result of said detection means in the open state of said pressing member is the same as the detection result of said original detection means in the closed state of said pressing member.

5. An apparatus according to claim 4, wherein said judging means judges an absence of the original when the detection result of said original detection means in the open state of said pressing member is different from the detection result of said original detection means in the closed state of said pressing member.

6. An original size detection apparatus comprising:
a placing table for placing an original thereon;
an openable/closable pressing member for covering the original placed on said placing table;
a plurality of original detection means, arranged at different positions below said placing table, for detecting a presence/absence of the original on said placing table;
open/closed detection means for detecting an open/-closed state of said pressing member;
means for judging in units of said plurality of original detection means whether or not the original is placed on said placing table, on the basis of outputs from said plurality of original detection means obtained when said open/closed detection means detects that said pressing member is in an open state and outputs from said plurality of original detection means obtained when said open/closed detection means detects that said pressing member is in a closed state; and
size detection means for detecting a size of the original placed on said placing table on the basis of a plurality of judgement results judged by said judging means in units of said plurality of original detection means.

7. An apparatus according to claim 6, wherein an original pressing surface of said pressing member comprises a low-density member.

8. An apparatus according to claim 6, wherein each of said plurality of original detection means comprises a light-emitting element and a light-receiving element.

9. An original detection means comprising:
a placing table for placing an original thereon;
an openable/closable pressing member for covering the original placed on said placing table;
original detection means, arranged below said placing table, for detecting a presence/absence of the original on said placing table;
means for generating first and second timing signals for causing said original detection means to detect the presence/absence of the original at different timings while said pressing member is shifted from an open state to a closed state; and
means for judging whether or not the original is placed on said placing table, on the basis of an output from said original detection means obtained when said generating means generates the first timing signal and an output from said original detection means obtained when said generating means generates the second timing signal.

10. An apparatus according to claim 9, wherein an original pressing surface of said pressing member comprises a low-density member.

11. An apparatus according to claim 9, wherein said original detection means comprises a light-emitting element and a light-receiving element.

12. An apparatus according to claim 9, wherein said judging means judges a presence of the original when the detection result of said original detection means when the first timing signal is generated is the same as the detection result of said original detection means when the second timing signal is generated.

13. An apparatus according to claim 12, wherein said judging means judges an absence of the original when the detection result of said original detection means when the first timing signal is generated is different from the detection result of said original detection means when the second timing signal is generated.

14. An apparatus according to claim 9, wherein said generating means comprises position detection means for detecting a position of said pressing member, and when said position detection means detects that said pressing member is in an open state, said generating means generates the first timing signal.

15. An apparatus according to claim 14, wherein said generating means generates the second timing signal a predetermined period of time after the first timing signal is generated.

16. An apparatus according to claim 14, wherein said generating means generates the second timing signal when said position detection means detects that said pressing member is in a closed state.

17. An apparatus according to claim 15, further comprising:
means for exposing the original; and
means for inputting an instruction for starting an operation of said exposing means,
wherein when the instruction is input before the predetermined period of time passes, said generating means generates the second timing signal in response to the input of the instruction.

18. An original size detection apparatus comprising:
a placing table for placing an original thereon;
an openable/closable pressing member for covering the original placed on said placing table;
a plurality of original detection means, arranged at different positions below said placing table, for detecting a presence/absence of the original on said placing table;
means for generating first and second timing signals for causing said original detection means to detect the presence/absence of the original at different timings while said pressing member is shifted from an open state to a closed state;

means for judging whether or not the original is placed on said placing table, on the basis of an output from said original detection means obtained when said generating means generates the first timing signal and an output from said original detection means obtained when said generating means generates the second timing signal; and size detection means for detecting a size of the original placed on said placing table on the basis of a plurality of judgement results judged by said judging means in units of said plurality of original detection means.

19. An apparatus according to claim 18, wherein an original pressing surface of said pressing member comprises a low-density member.

20. An apparatus according to claim 18, wherein each of said plurality of original detection means comprises a light-emitting element and a light-receiving element.

21. An original exposure apparatus for exposing an original placed on a placing table, comprising:

a plurality of light-emitting means for illuminating a plurality of positions on said placing table;

a plurality of light-receiving means paired with said light-emitting means;

means for detecting a size of the original placed on said placing table on the basis of outputs from said plurality of light-receiving means; and means for changing at least one of at least one amount of light of said plurality of light-emitting means and at least one light-receiving sensitivity of said plurality of light-receiving means so as to adjust a detection operation of said detecting means.

22. An apparatus according to claim 21, wherein said changing means changes a duty ratio of a pulse for driving said light-emitting means so as to change an amount of light of said light-emitting means.

23. An apparatus according to claim 21, further comprising:

means for selecting light-emitting means to be changed by said changing means.

24. An apparatus according to claim 21, further comprising:

means for selecting light-receiving means to be changed by said changing means.

25. An apparatus according to claim 21, wherein said changing means changes a frequency of a pulse for driving said light-emitting means so as to adjust the light-receiving sensitivity of said light-receiving means.

26. An apparatus according to claim 25, wherein a duty ratio of the pulse is constant regardless of the frequency.

27. An apparatus according to claim 21, wherein said changing means changes a threshold value for binarizing the outputs from said light-receiving means so as to adjust the light-receiving sensitivity of said light-receiving means.

* * * * *